US007608154B2

(12) United States Patent
O-hashi et al.

(10) Patent No.: US 7,608,154 B2
(45) Date of Patent: Oct. 27, 2009

(54) NONORIENTED ELECTRICAL STEEL SHEET EXCELLENT IN CORE LOSS

(75) Inventors: Wataru O-hashi, Futtu (JP); Masafumi Miyazaki, Futtu (JP); Yousuke Kurosaki, Futtu (JP); Takeshi Kubota, Futtu (JP)

(73) Assignee: Nippon Steel Corporation, Tokyo (JP)

( * ) Notice: Subject to any disclaimer, the term of this patent is extended or adjusted under 35 U.S.C. 154(b) by 224 days.

(21) Appl. No.: 11/663,095

(22) PCT Filed: Sep. 9, 2005

(86) PCT No.: PCT/JP2005/017079

§ 371 (c)(1),
(2), (4) Date: Mar. 16, 2007

(87) PCT Pub. No.: WO2006/033286

PCT Pub. Date: Mar. 30, 2006

(65) Prior Publication Data

US 2008/0118389 A1 May 22, 2008

(30) Foreign Application Priority Data

Sep. 22, 2004 (JP) ..... 2004-274696
Aug. 22, 2005 (JP) ..... 2005-239600

(51) Int. Cl.
*H01F 1/147* (2006.01)

(52) U.S. Cl. ..... 148/309; 148/111; 148/121; 148/306; 148/307

(58) Field of Classification Search ..... None
See application file for complete search history.

(56) References Cited

U.S. PATENT DOCUMENTS 6,478,892 B2 * 11/2002 Murakami et al. ..... 148/306
2002/0066500 A1 6/2002 Kawano et al.
2006/0185767 A1 * 8/2006 Arita et al. ..... 148/111
2008/0112838 A1 * 5/2008 Miyazaki et al. ..... 420/40

FOREIGN PATENT DOCUMENTS

JP 51-62115 A 5/1976

(Continued)

OTHER PUBLICATIONS

Patent Abstracts of Japan, English Language Abstract of Japanese Patent Document No. 60-238421, Nov. 1985.*

(Continued)

*Primary Examiner*—John P. Sheehan
(74) *Attorney, Agent, or Firm*—Birch, Stewart, Kolasch & Birch, LLP

(57) ABSTRACT

A nonoriented electrical steel sheet excellent in core loss comprising copper sulfides with a sphere-equivalent radius of 100 nm or less, wherein the number density of the copper sulfides is less than $1\times10^{10}$ [inclusions/mm$^3$]. Preferably, the percentage of the number of copper sulfides with a (major axis)/(minor axis) ratio of more than 2 per total number of copper sulfides is 30% or less. The steel preferably further comprises Cu of 0.5 mass % or less and REM of 0.0005% or more and 0.03% or less, wherein the following expression (1) or expressions (1) and (2) are met:

$$[REM]\times[Cu]^3 \geqq 7.5\times10^{-11} \quad (1),$$

$$([REM]-0.003)^{0.1}\times[Cu]^2 \leqq 1.25\times10^{-4} \quad (2).$$

2 Claims, 4 Drawing Sheets

FOREIGN PATENT DOCUMENTS

| | | | |
|---|---|---|---|
| JP | 60-238421 | * | 11/1985 |
| JP | 63-114918 | A | 5/1988 |
| JP | 3-215627 | A | 9/1991 |
| JP | 2004-2954 | A | 1/2004 |
| JP | 2005-200713 | A | 7/2005 |

OTHER PUBLICATIONS

Kurosawa et al., "Observations of Precipitates and Mettalographic Grain Orientation in Steel by a Non-aqueous Electrolyte-Potentiostatic Etching Method", J. Japan Inst. Metals, vol. 43, 1979, pp. 1068-1077.

* cited by examiner

NONORIENTED ELECTRICAL STEEL SHEET EXCELLENT IN CORE LOSS

BACKGROUND OF THE INVENTION

This application claims priority to Japanese patent application No. 2004-274696, filed in Japan on Sep. 22, 2004, and Japanese patent application No. 2005-239600, filed in Japan on Aug. 22, 2005, the entire contents of which are herein incorporated by reference.

Field of the Invention

The present invention relates to a nonoriented electrical steel sheet, which is excellent in lower core loss after annealing. The present steel is used as part of electrical machinery and devices. For instance, the present steel is used as the magnetic core materials for motors to provide high efficiency and lower energy loss.

When the nonoriented electrical steel sheet is used as core materials such as motors, some end users blank/punch the sheet to prepare a specific shaped sheet. The accuracy of the punching is high when the grain size is small. A grain size of less than 40 μm, for example, is preferable for this purpose. On the other hand, as for the magnetic property of the final product, especially core loss, larger crystal grain size, such as more than 100 μm, is preferable for lower core loss. To meet these contradictory demands, steel sheet products having small grain sizes are shipped to the users. Then, after punching the steel sheets, the users practice annealing, called stress relief annealing, for grain growth. Recently the demand for low core loss steel materials has increased and the users have been trying to shorten the time for stress relief annealing in order to increase productivity. This leads to a high demand for a nonoriented steel sheet that has good grain growth.

One of the main factors in inhibiting grain growth is inclusions and precipitates which are finely dispersed in the steel. When the number of the inclusions is large and the size of the inclusions is small, the grain growth is more inhibited. As Zener suggested, if the ratio r/f (where "r" represents a sphere-equivalent radius of the inclusions and "f" represents a volume occupancy rate of the inclusions in the steel) is small, the grain growth is inhibited. Therefore, to increase the speed of grain growth, the ratio r/f should be large. That is, not only decreasing the number of inclusions but also increasing the size of the inclusions is important.

Inclusions which inhibit the grain growth in the nonoriented electrical steel sheet are, for example, oxides such as silica or alumina, sulfides such as manganese sulfide or copper sulfides, and nitrides such as aluminum nitride or titanium nitride. Hereinafter, the term "inclusion" refers to a nonmetallic inclusions or precipitates in the steel such as above-mentioned oxides, sulfides and nitrides, for example. Among these inclusions, sulfides are often the main factor for inhibiting grain growth since sulfides make dispersed precipitates in the cooling process of the annealing after rolling. This easily forms a great number of fine size sulfides. Among them, copper sulfides, such as CuS or $Cu_2S$, which are found in electrical steel sheets containing Cu, precipitate at temperatures of around 1000-1100° C., which are lower than other sulfides such as manganese sulfides, which precipitate at about 1100-1200° C. Consequently, copper sulfides inhibit grain growth more than other sulfides since copper sulfides dissolve and re-precipitate at a lower temperature in the annealing process after rolling, which leads to the formation of finer copper sulfides.

High-purity molten steel provides a steel sheet free from the hazardous effect of sulfides. Complete desulfurization of the molten steel by flux refining is one example that is suitable for the purpose of inhibiting formation of sulfides. However, this cannot always be efficient or effective since it may bring higher costs caused by an increase of refining process or contamination of the molten steel caused by fusing damage of refractory material. Another way for making the sulfides harmless is by addition of various elements to the steel. As for sulfides, a method for fixing S by adding specific elements including rare earth metal elements (hereinafter referred to as REM) is known, as shown in Published patent application S51-62115 or H03-215627 (JP S51-62115 A or JP H03-215627 A). This method utilizes the strong desulfurizing effect of REMs, where formation of sulfides, particularly manganese sulfides, is suppressed by adding appropriate amounts of REMs depending on the amount of S contained in the steel.

As for the REM's inhibiting effect of sulfide formation, further description is made below. "REM" is a collective term for 17 elements including scandium (atomic number 21), yttrium (atomic number 39) and 15 elements from lanthanum (atomic number 57) to lutetium (atomic number 71). In an ordinary method, REMs are added during the refining process or at the molten steel stage before casting. The REMs in the nonoriented electrical steel allow formation of REM oxysulfides and/or REM sulfides because there is not enough oxygen to form REM oxides in the steel. This is because nonoriented electrical steel contains deoxidizing elements (oxygen scavengers) such as Si and/or Al, which causes the steel to have less oxygen compared to other carbon steels. Consequently, when enough REMs are added to the electrical steel, S in the steel is fixed with the REMs through the formation of REM oxysulfides and/or REM sulfides, which leads to almost no other sulfides.

However, the required amounts of REM for fixing S in the steel is 4-8 times or more than the amount of S by mass % according to calculations based on the chemical composition. Thus, addition of sufficient REMs to fix S in the steel increases the cost. On the one hand, insufficient addition causes incomplete fixation of S in the steel, which leads to formation of sulfides other than REM sulfides.

SUMMARY OF THE INVENTION

Figure 1:
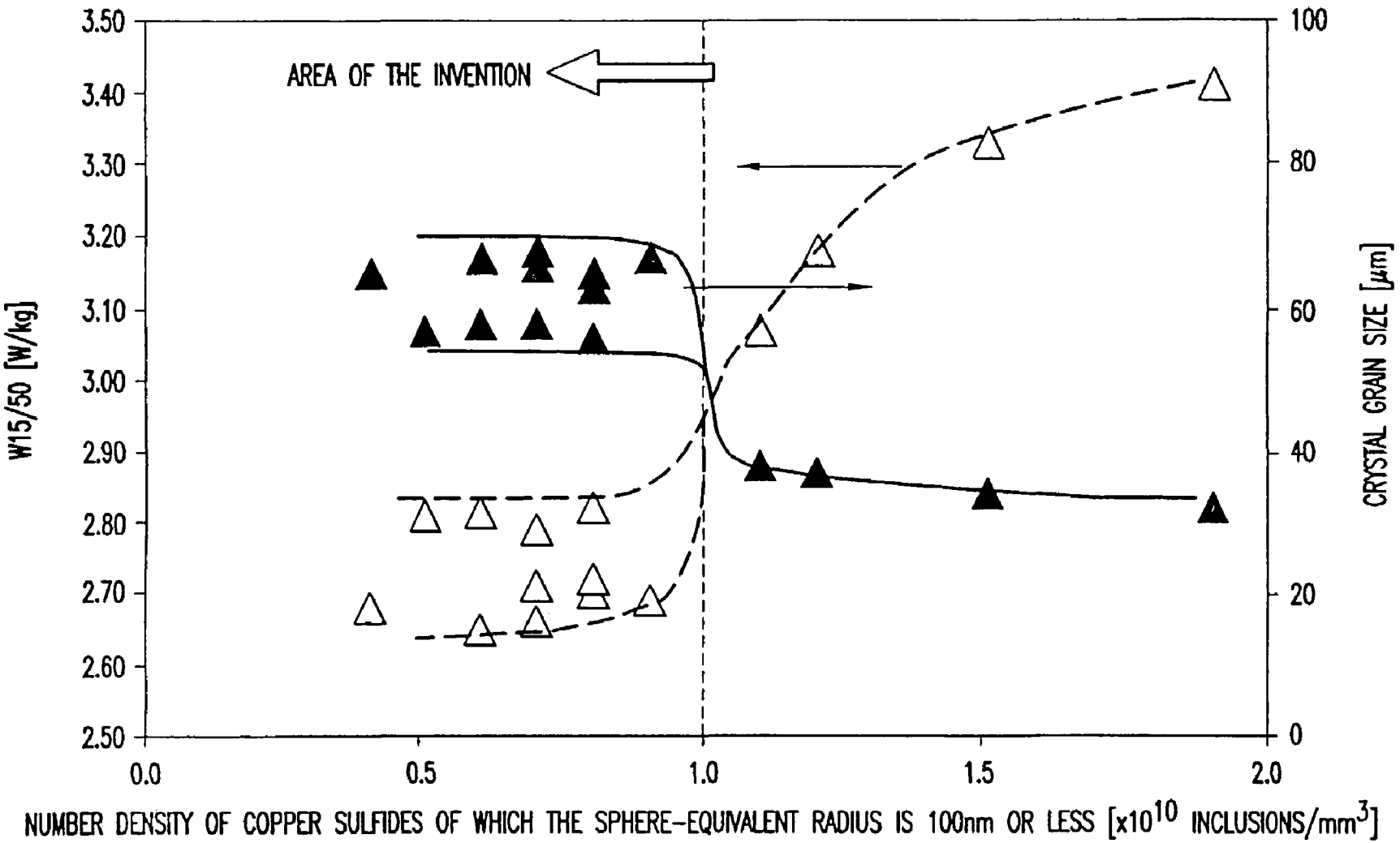
FIG. 1 is a graph showing the influence of the number density of copper sulfides in steel on grain size and magnetic property.

An object of the present invention is to provide a nonoriented electrical steel sheet excellent in grain growth by controlling the size, number density and shape of sulfides, particularly copper sulfides, existing in a steel sheet containing Cu, without using a large amount of REMs.

The gist of the present invention is as follows.

Item 1. A nonoriented electrical steel sheet, wherein of the number density of copper sulfides having a sphere-equivalent radius of 100 nm or less is less than $1\times10^{10}$ [inclusions/mm$^3$]

Item 2. A nonoriented electrical steel sheet according to item 1, wherein the copper sulfides with a (major axis)/(minor axis) ratio of more than 2 is 30% or less in the copper sulfides having a sphere-equivalent radius of 100 nm or less. It is noted that copper sulfides with a (major axis)/(minor axis) ratio of more than 1 are defined as "bar type" and a ratio 2 is just used as a practical and simple index in the present invention. Therefore, copper sulfides with a (major axis)/(minor axis) ratio ranging from more than 1 to less than 2 are also within the subject matter of the present invention.

Item 3. A nonoriented electrical steel sheet according to item 1, further comprising: by mass %, C: 0.01% or less,
Si: 0.1% or more and 7.0% or less,
Al: 0.005% or more and 3.0% or less,
Mn: 0.1% or more and 2.0% or less,
S: 0.0005% or more and 0.005% or less,
Cu: 0.5% or less,
REM: 0.0005% or more and 0.03% or less, and the balance Fe and unavoidable impurities, wherein the following expression (1) is met, $$[REM]\times[Cu]^3\geqq7.5\times10^{-11} \quad (1)$$

where [REM] represents REM mass % and [Cu] represents Cu mass %.

Item 4. A nonoriented electrical steel sheet according to item 2, further comprising: by mass %, C: 0.01% or less,
Si: 0.1% or more and 7.0% or less,
Al: 0.005% or more and 3.0% or less,
Mn: 0.1% or more and 2.0% or less,
S: 0.0005% or more and 0.005% or less,
Cu: 0.5% or less,
REM: 0.0005% or more and 0.03% or less, and the balance Fe and unavoidable impurities, wherein if $0.0005\leqq[REM]<0.003$, the following expression (1) is met, and if $0.003\leqq[REM]\leqq0.03$, expression (1) above, in addition to the following expression (2), are met, $$([REM]-0.003)^{0.1}\times[Cu]^2\leqq1.25\times10^{-4} \quad (2),$$

where [REM] represents REM mass % and [Cu] represents Cu mass %.

The present invention makes it possible, without using a large amount of REMs, to control the size, number density and shape of fine copper sulfides which inhibit grain growth in nonoriented electrical steel sheets within an appropriate range. This results in a large enough increase in the grain size to lower core loss. The present invention also enables easier stress relief annealing after punching, which satisfies the demands of the steel sheet users and leads to energy savings.

DESCRIPTION OF THE PREFERRED EMBODIMENT

As mentioned above, copper sulfides such as CuS or $Cu_2S$ precipitate at lower temperatures around 1000-1100° C. compared to other sulfides such as manganese sulfide which precipitate at about 1100-1200° C. Consequently copper sulfides dissolve and re-precipitate in the annealing process at lower temperatures than other sulfides. Finer precipitation leads to less grain growth. Thus, copper sulfides have a greater effect on inhibition of grain growth. In order to suppress the effect of copper sulfides, it is important to reduce the number density of copper sulfides in the steel as much as possible.

A method for measuring the number density of copper sulfides is described below by way of an example. First, a test sample plate is ground to an appropriate thickness to form a mirror surface. After etching the sample plate (to be described hereinafter), a replica is obtained and the copper sulfides transferred to the replica are observed using a field-emission type transmission electron microscope. Instead of the replica, a thin film can be prepared for observation. The radius and number density of the copper sulfides are evaluated by measuring all inclusions in a predetermined observation area. The composition of the copper sulfides are determined through EDX and diffraction pattern analysis. Since the minimum radius of copper sulfide nuclei that can stably exist is about 5 nm, a method that enables an observation of the size should be selected. Copper sulfides can be extracted by etching. One example of etching is a method by Kurosawa et al., (KUROSAWA, Fumio; TAGUCHI, Isamu and MATSUMOTO, Ryutarou, J. Japan Inst. Metals, 43 (1979), p. 1068) where the sample is subjected to electrolytic etching in a nonaqueous solvent to dissolve only the steel in order to leave the copper sulfides undissolved.

After diligent research using the above methods, the present inventors have found that if the number density of copper sulfides with a sphere-equivalent radius of 100 nm or less is less than $1\times10^{10}$ [inclusions/mm$^3$], nonoriented electrical steel sheets with good grain growth and good core loss are obtained. Further, better grain growth and better core loss can be obtained if the number of copper sulfides with a (major axis)/(minor axis) ratio of more than 2 is 30% or less in the total number of the copper sulfides with a sphere-equivalent radius of 100 nm or less include copper sulfides.

A detailed description is made below using FIG. 1-FIG. 5.

FIG. 1 is a graph showing the influence of the number density of copper sulfides contained in the sample on grain size and magnetic property. The horizontal axis represents the number density of copper sulfides with a sphere-equivalent radius of 100 nm or less in the steel. The left and right vertical axis represents a core loss and grain size after stress relief annealing, respectively. The broken line with the symbol "Δ" with reference to the left vertical axis indicates the dependency of the core loss on the number density. A value of "W15/50" is used as the core loss. Lower core loss is better. The line with the symbol "▲" with c reference to the right vertical axis indicates the dependency of the grain size on the number density. Larger grain size is better.

Figure 2:
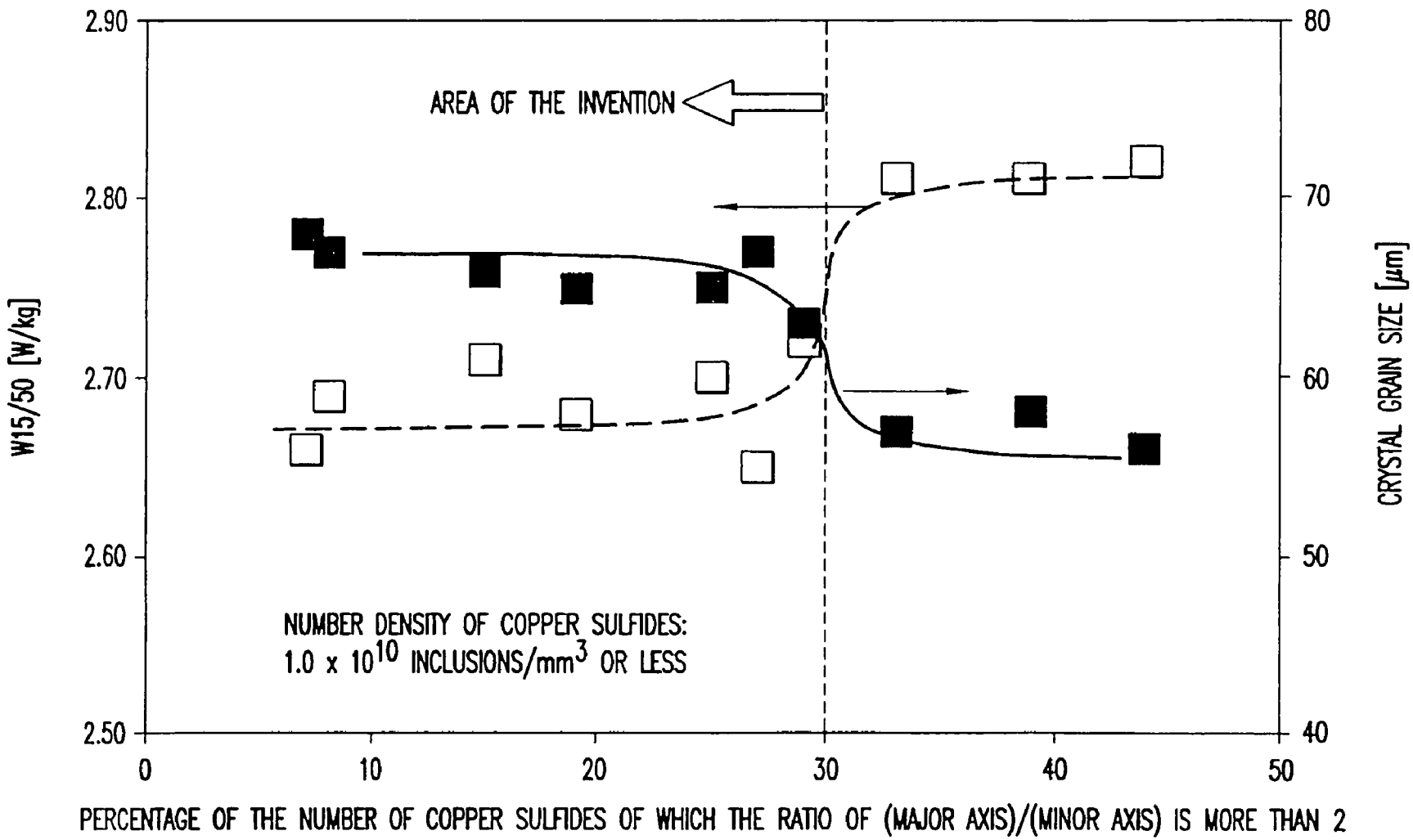
FIG. 2 is a graph showing the influence of the percentage of the number of copper sulfides with a ratio of (major axis)/(minor axis) of more than 2 and a sphere-equivalent radius of 100 nm or less on grain size and magnetic property.

FIG. 2 is a graph showing the influence of the percentage of copper sulfides with a (major axis)/(minor axis) ratio of 2 or more in the sulfides with a sphere-equivalent radius of 100 nm or less on grain size and core loss. The horizontal axis represents the percentage of the copper sulfides, the left vertical axis represents core loss by W15/50 for the broken line with the symbol "□", and the right vertical axis represents the grain size for the line with the symbol "■". Lower core loss and larger grain size are better.

Figure 3:
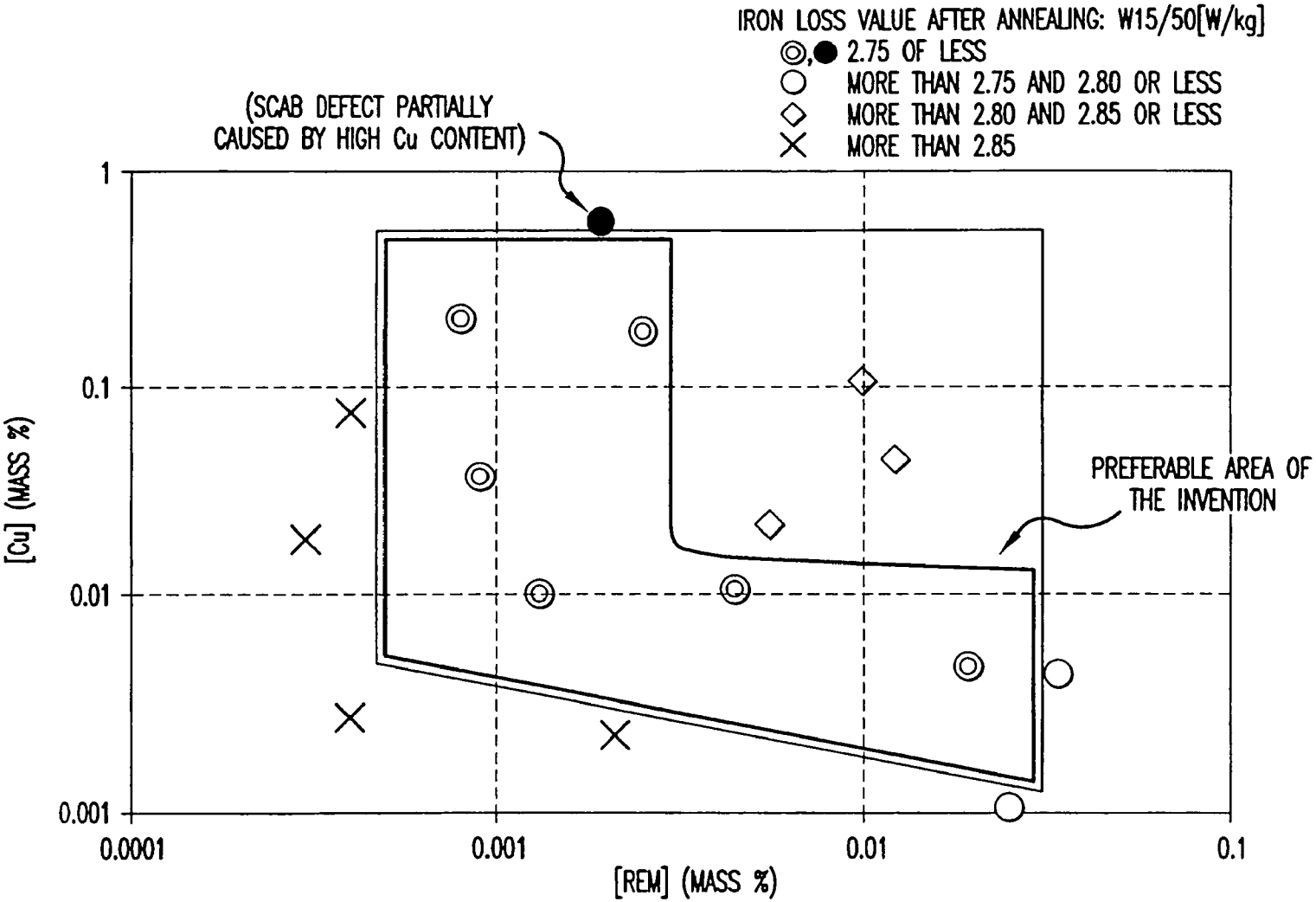
FIG. 3 is a graph showing the influence of REM content and Cu content on magnetic property.

FIG. 3 is a graph showing the influence of REM content and Cu content in a nonoriented electrical steel sheet on the magnetic property of the sheet evaluated by core loss. The symbol ◎ represents a sheet of an excellent performance with a core loss 2.75 or less. The symbol ○ represents a sheet whose core loss is more than 2.75 and not greater than 2.80. The symbol ◇ represents a sheet whose core loss is more than 2.80 and not greater than 2.85. The symbol X represents a sheet whose core loss is more than 2.85. The symbol ● represents a sheet with excellent core loss, i.e., 2.75 or less, but a scab defect is partially developed on the surface of the product sheet.

Figure 4:
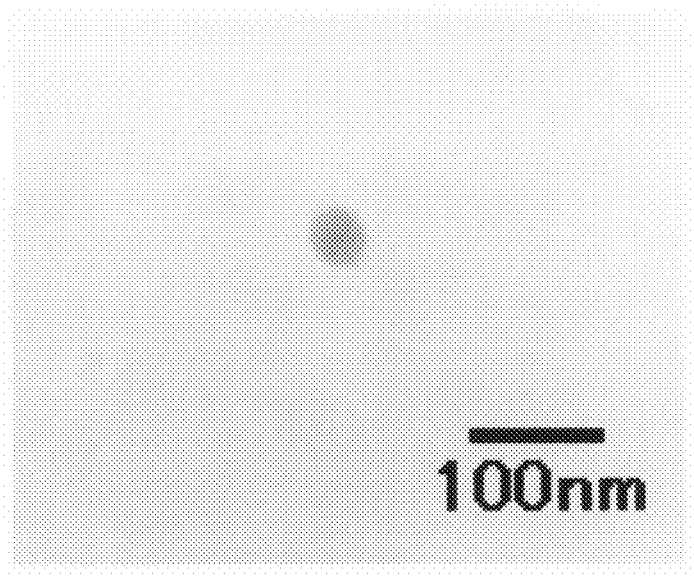
FIG. 4 is a photo showing an example of a copper sulfide with a sphere-equivalent radius of 100 nm or less.
Figure 5:
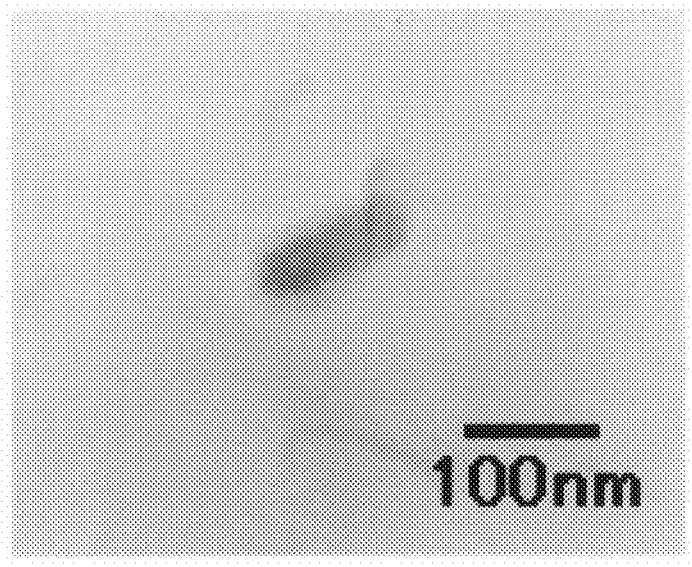
FIG. 5 is a photo showing an example of a copper sulfide with a sphere-equivalent radius of 100 nm or less and a (major axis)/(minor axis) ratio of more than 2.

FIGS. 4 and 5 show examples of copper sulfides in steel with a sphere-equivalent radius of 100 nm or less. FIG. 4 shows an example of a copper sulfide with a (major axis)/(minor axis) ratio of less than 2. FIG. 5 shows an example of a copper sulfide with a ratio (major axis)/(minor axis) ratio of more than 2.

Samples of nonoriented electrical steel sheets containing by mass % Si of 2.2%, Al of 0.28%, S of 0.002%, Cu ranging 0.005-0.2%, REM ranging 0.0008-0.012% and the balance iron and unavoidable impurities are prepared. Then, the size, shape and number density of copper sulfides contained in the samples, the grain size, and magnetic property of the samples are investigated. REMs are added, for example in types of materials such as alloys including REMS, mischmetal and iron-silicon-REM alloys having various shapes such as shot, block C and/or wire into the molten steel at the stage such as RH process. Although Ce is a useful and preferable element among the 17 REM elements, other elements can be also used according to the features.

Copper sulfides with a sphere-equivalent radius of 100 nm or less such as shown in FIG. 4 account for the main part of copper sulfides contained in the samples. These fine copper sulfides inhibit the grain growth. As shown in FIG. 1, measurement of samples having different number density of copper sulfides with a sphere-equivalent radius of 100 nm or less indicates that there is a critical point at number density of copper sulfides of $1\times10^{10}$ [inclusions/mm$^3$]. If the number density of copper sulfides is $1\times10^{10}$ [inclusions/mm$^3$] or less, good grain growth and good core loss resulting therefrom can be obtained. Further analysis of the samples with a number density of $1\times10^{10}$ [inclusions/mm$^3$] or less makes it clear that among the variation of the growth of crystal grains and core loss, excellent samples in magnetic property are proved to show that the percentage of the number of copper sulfides with a (major axis)/(minor axis) ratio of more than 2 is 30% or less as shown in FIG. 2.

FIG. 4 shows an example of a copper sulfide with a sphere-equivalent radius of 100 nm or less and a (major axis)/(minor axis) ratio of not more than 2. FIG. 5 shows an example of a copper sulfide with a sphere-equivalent radius of 100 nm or less and a (major axis)/(minor axis) ratio of more than 2. If the shape of an inclusion is "bar type", i.e. the (major axis)/(minor axis) ratio is more than 1, the inhibition effect of the inclusion on grain growth becomes strong, and not preferable. The reason for the increased inhibition effect seems that bar type copper inclusions make it difficult for a grain boundary to pass through and strengthens the pinning effect on grain boundary migration. This leads to an increase of the inhibition effect on grain growth. A ratio 2 of (major axis)/(minor axis) is just used as a practical and simple index in the present invention. Therefore, copper sulfides with a (major axis)/(minor axis) ratio ranging from more than 1 to less than 2 are also within the scope of the present invention.

Preferable conditions of the steel component to obtain the aforementioned preferable cupper sulfides in number density and shape are described in reference to FIG. 3. It is generally known that in order to inhibit the formation of sulfides in nonoriented electrical steel sheets, the content of elements capable of bonding with S to form sulfides should be reduced in the case of adding REM. For example, the manganese content should be reduced to prevent the formation of manganese sulfides and the copper content should be reduced to prevent the formation of copper sulfides. However, the inventors of the present invention have discovered that in the case of adding REMs to the steel, within a limited range of Cu content, a larger content of Cu can reduce the inhibition effect of copper sulfides on grain growth. That is, appropriate combination of amounts of REMs to be added and of the Cu content in the steel was found to improve the grain growth.

When REMs are added to the steel, REM sulfides and/or REM oxysulfides are formed. S in the steel is consumed by the REMs, which causes the area in the vicinity of REMs to be lacking in S. Consequently, copper sulfides are not formed in the vicinity of REMs and copper sulfides can only be formed in S-rich areas. In this situation, even if the Cu content is increased in steel, almost no new copper sulfides are formed since S is absent, and an increased amount of Cu contributes only to the growth of preexisting copper sulfides. In other words, the number of copper sulfides does not increase but the size of copper sulfides does increase. Distribution of copper sulfides, i.e. distribution of S in the steel, is correlated with the amounts of REMs in the steel and the size of copper sulfides is correlated with the amount of Cu in the steel. In view of this, the present inventors thought that the concentration product of the REM content and the Cu content relates to the effect on increasing the size of copper sulfides without increasing the number of copper sulfides.

It is found that if $0.0005 \leqq [REM] \leqq 0.03$, $[Cu] \leqq 0.5$, where [REM] represents the REM content by mass % and [Cu] represents the Cu content by mass %; and [REM] and [Cu] meet the following expression (1), the number of copper sulfides do not increase but the size of copper sulfides do increase. This can reduce the grain growth inhibition effect of copper sulfides, which leads to expediting grain growth and lowering core loss.

$$[REM]\times[Cu]^3 \geqq 7.5\times10^{-11} \quad (1)$$

As shown by the data in FIG. 3 (where the symbol ◎ means an excellent performance of the product with a core loss of 2.75 or less; the symbol ○ means that the core loss is more than 2.75 and not greater than 2.80; the symbol ◇ means that the core loss is more than 2.80 and not greater than 2.85; the symbol X means that the core loss is more than 2.85; and the symbol ● means that the core loss is excellent, i.e., 2.75 or less but not allowable as a product for some other reason) it is found that in the case where the REM content or the Cu content are too low, therefore the value of $[REM]\times[Cu]^3$ does not reach $7.5\times10^{-11}$, i.e., does not meet the expression (1), a good magnetic property is not obtained. On the contrary, in the case where the value of $[REM]\times[Cu]^3$ reaches $7.5\times10^{-11}$ or more, i.e., meets the expression (1), a good magnetic property can be obtained.

When the REM content in the steel is extremely low, S fixation by REMs is extremely insufficient. Consequently, a great number of fine copper sulfides with a sphere-equivalent radius of 100 nm or less are formed in the steel. This inhibits grain growth and leads to a poor magnetic property. In order to obtain a good magnetic property, it is preferable for the REM content to be 0.0005% or more as indicated in FIG. 3. However, if the REM content exceeds 0.03%, excess amounts of REM oxysulfides and/or REM sulfides are formed, which inhibit the grain growth and may lead to a poor magnetic property. As for the content range of Cu, 0.001% or more is preferable in view of an effective amount for controlling the strength of the steel and the crystalline texture. When the Cu content exceeds 0.5%, it may cause a scab defect. In view of the above, the [REM] is preferably 0.03% or less and the [Cu] is preferably 0.5% or less in terms of a combination of [REM] and [Cu].

As described above, the present inventors found that a good magnetic property can be obtained by controlling the number density and size of copper sulfides by keeping the REM content and the Cu content in the steel within the scope shown in FIG. 3, more preferably within the area surrounded by the fine line in FIG. 3. It is also found that more preferable conditions are obtained within the L-shaped area surrounded by the bold line in FIG. 3, i.e., only the symbol ◎ existing area, where the Cu content and the REM content are within an appropriate range, the number density of the copper sulfides is also within an appropriate range, copper sulfides are not developed to form bar shape copper sulfides, and good grain growth and magnetic property can be obtained.

The basic mechanism of shape change of copper sulfides into bar type copper sulfides is similar to the mechanism concerning the phenomenon wherein the size of copper sulfides increase without increasing the number of copper sulfides. That is, when the S distribution in steel becomes non-uniform resulting from S being fixed with REMs, if there is an excess amount of Cu, which does not increase the number of copper sulfides but increases the growth of preexisting copper sulfides, this results in a growth in a direction of preference to form elongate shaped copper sulfides. In view of this, an effect of governing the shape of copper sulfide is thought to be correlated with the REM amount to cause non-uniform S distribution in the steel and concentration product of the REM content and the Cu content.

In the case where $0.003 \leqq [REM] \leqq 0.03$, there are a relatively large amount of REMs in the steel. Therefore, S fixation with REMs can be widely made in the steel, which can cause S distribution in the steel to be so non-uniform that the growth of copper sulfides can be limited in the direction of preference. In this case, if the Cu content is controlled to be within an appropriate range according to a value of the REM content, which makes it possible to keep the percentage of the number of bar type copper sulfides to 30% or less, this provides good grain growth and good magnetic property.

In the case where $0.0005 \leqq [REM] < 0.003$, there are a relatively small amount of REMs in the steel. Therefore, S fixation with REMs cannot be widely made in the steel. In other words there remains a wide area where S distribution in the steel is uniform (not non-uniform). This degree of non-uniformity is insufficient to limit the growth of copper sulfides in the direction of preference. This makes it possible to keep the percentage of the number of bar type copper sulfides to 30% or less, which provides good grain growth and good magnetic property.

In view of all of the above, the present inventors found that following conditions are obtained:

The number of copper sulfides do not increase, the size of copper sulfides increases, the percentage of the number of bar type copper sulfides iscan be 30% or less, the inhibiting effect on grain growth by copper sulfides is low and grain growth and core loss is much improved; if $$0.0005 \leqq [REM] < 0.003 \text{ and}$$

$$[REM] \times [Cu]^3 \geqq 7.5 \times 10^{-11} \quad (1),$$

or if $$0.003 \leqq [REM] \leqq 0.03,$$

$$[REM] \times [Cu]^3 \geqq 7.5 \times 10^{-11} \quad (1) \text{ and}$$

$$([REM] - 0.003)^{0.1} \times [Cu]^2 \leqq 1.25 \times 10^{-4} \quad (2).$$

Examples represented by the symbol ◇ in FIG. 3 have a better product property than conventional products. As shown by the symbol ◎ within the area surrounded with the bold line in FIG. 3, when the [REM] and the [Cu] have a more preferable value, and the number density of copper sulfides and the percentage of the number of bar type copper sulfides have appropriate values, the product property can be much better. Thus, it is found that a much better magnetic property can be obtained if the REM content and the Cu content in the steel are selected so as to be within the area surrounded with the bold line in FIG. 3.

It is also found for the first time that the effect mentioned above cannot be expected only by lowering the S content in the steel but expected when REMs are added into the steel to fix S by the REMs and further the Cu content is adjusted to an appropriate value. As a REM element, one or more elements in combination can be used to exert the effect as long as they are within the scope of the present invention.

The reason for the limitation on components other than REMs and Cu in the present invention are described below.

[C]: C is the cause of magnetic aging by precipitation of C. Thus, the C content is preferably 0.01 mass % or less in the steel sheet. The lower limit includes 0 (zero) % but practically the lower limit may be 1-5 ppm.

[Si]: Si is used for reducing core loss. If the Si content is less than 0.1 mass %, core loss is degraded. It is industrially difficult and expensive to make a steel containing Si of more than 7.0 mass %. Thus, the lower limit of the Si content is preferably 0.1 mass % and the upper limit is preferably 7.0 mass %.

[Al]: Al is used for reducing core loss similar to Si. If the Al content is less than 0.005 mass %, the core loss is degraded. If the Al content is more than 3 mass %, the cost drastically increases.

[Mn]: An Mn content of 0.1 mass % or more is preferred to increase the hardness of the steel sheet and to improve the punching property. The upper limit of the Mn content, preferably 2.0 mass %, results from economic reasons.

[S]: S as a copper sulfide and/or manganese sulfide degrades the growth of crystal grains and core loss. In this invention, although S can be fixed by REMs, the upper limit of S content is preferably 0.005 mass % or less from a practical point of view. The lower limit is preferably 0.0005% to suppress the cost increase of desulfurization.

Manufacturing conditions for the product of the present invention are described below. When refining is carried out using a converter or a secondary refining furnace at the steel making stage, it is preferable to keep the degree of oxidation of the slag, i.e., mass ratio of (FeO+MnO) to slag, to 3.0% or less. If the oxidation degree of the slag is more than 3.0%, REMs in the molten steel are unnecessarily oxidized forming only oxides using oxygen fed from the slag. This may result in the lack of formation of REM sulfides and/or REM oxysulfides, i.e., S fixation in the steel becomes insufficient. It is also preferable to eliminate oxidizing sources from the ambient surroundings, as much as possible, for example by examining the refractory lining. It is preferable to take 10 minutes or more between the REM addition step and the casting step to give enough time for REM oxides, which are inevitably formed by oxidization from the ambient atmosphere at REM addition, to float up to the surface. The above-described practice makes it possible to prepare steel with the intended chemical composition. After preparing the molten steel having the intended chemical composition in this manner, the molten steel is cast to a slab or the like using a continuous casting or an ingot casting process. The cast steel is hot-rolled, annealed if required, and cold-rolled once or more than twice with intermediate annealing to have the predetermined product thickness. Finally, finish annealing is conducted and an insulating coating is applied.

EXAMPLES

Steels of composition by mass % C of 0.002%, Si of 2.2%, Al of 0.28%, Mn of 0.2%, S of 0.002%, and Cu and REM of various contents shown in TABLE 1, were prepared by melting and refining, and subjected to continuous casting, hot rolling, hot band annealing, cold rolling to form steel sheets of 0.50 mm thickness, finish annealing at 850° C. for 30 seconds, and finally insulating coating is applied to finish the sheet product. For REM, a REM alloy containing about 95% of La and Ce was charged at the RH stage. The grain sizes of the steel sheets ranged from 30 μm to 33 μm. After stress relief annealing at 750° C. for 1.5 hours that is shorter than conventional annealing, grain sizes, magnetic properties and inclusions were measured and analyzed. The magnetic property was measured using the 25 cm Epstein test. The inclusions were measured using the method set forth above. The grain size was measured as the average grain size after emerging crystal grain by applying nital-etching to mirror-ground cross-section surface of the steel sheet. The results are shown in TABLE 1 and FIGS. 1, 2 and 3.

Table 1

Sample Nos. 1-6 are a group which achieved the best product properties, where the composition of the steel is within the appropriate range of the present invention, and the number density, the percentage of the number of bar type copper sulfides and expressions (1) and (2) are all met. The number density was measured by the aforementioned method and the results show that the number density of fine copper sulfides with a sphere-equivalent radius of 100 nm or less is $0.4–0.9\times10^{10}$ [inclusions/mm$^3$], which is not more than $1.0\times10^{10}$ [inclusions/mm$^3$]. The percentage of the number of copper sulfides with a (major axis)/(minor axis) ratio of more than 2 is 7-27% is not more than 30%. As sulfides other than copper sulfides, REM oxysulfides and REM sulfides with s size of 0.2-3.5 μm are observed. In view of this, it is clear that fine copper sulfide formation is inhibited by fixing S with REMs in the steel. This is through formation of REM oxysulfides and/or REM sulfides, which leads to good grain growth. Grain size, after stress relief annealing, is as large as 65-68 μm, indicating good grain growth. The magnetic property represented by core loss W15/50 is 2.65-2.71 [W/kg], which is preferable low value. These described values correspond to the symbol ◎ data.

In sample Nos. 7-9, the number density of copper sulfides with a sphere-equivalent radius of 100 nm or less is not more than $1.0\times10^{10}$ [inclusions/mm$^3$]. However, the percentage of the number of copper sulfides with a (major axis)/(minor axis) ratio of more than 2 is more than 30%, making the grain size after stress relief annealing relatively small such as 56-58 μm. The core loss is relatively large such as 2.81-2.82 [W/kg]. The symbol ◇ data of FIG. 3 correspond to these samples.

In sample No. 10, the number density of copper c sulfides with a sphere-equivalent radius of 100 nm or less is not more than $1.0\times10^{10}$ [inclusions/mm$^3$]. The percentage of the number of bar type copper sulfides is not more than 30%. However, the Cu content is so little that expression (1) cannot be met, which leads to a relatively large core loss of 2.79 [W/kg], and a relatively small grain size of 58 μm. The symbol ○ data at the right bottom on the horizontal axis in FIG. 3 correspond to this sample.

In 4 samples (sample Nos. 11-14) for comparison samples, the number density of the copper sulfides with a sphere-equivalent radius of 100 nm or less, is more than $1.0\times10^{10}$ [inclusions/mm$^3$] correspond to the data located in the right hand area from the dashed line in FIG. 1. The grain size after stress relief annealing is so small (38 μm) and core loss exceeds 3.0 [W/kg]. The symbol X data in FIG. 3 correspond to these samples.

Sample No. 15 meets the requirements of the number density and the percentage of the number of bar type copper sulfides of the invention. However, the REM content is too high, which leads to a relatively large core loss of 2.76 [W/kg], and a grain size after stress relief annealing which is relatively small (60 μm). As sulfides other than copper sulfides in the product, REM oxysulfides and REM sulfides with sizes of 0.2 μm-3.5 μm are found elongated in the rolling direction, which makes it clear that the REM oxysulfides and REM sulfides inhibit grain growth in the sheet thickness direction. The symbol ○ data positioned on the right-hand side of the L-shaped area (not on the horizontal axis) in FIG. 3 corresponds to this sample.

In sample No. 16, the requirements of the invention, the number density, the percentage of the number of bar type c copper sulfides and expressions (1) and (2) are all met. In this sample, a scab defect is developed on the surface of the steel sheet product (in the vicinity of edge) since the Cu content is slightly more than 0.5%. However, since the location of the scab defect, i.e., the vicinity of edge, is not a portion used to make a final product for punching, it does not cause a problem such as lowering the yield rate. The core loss is 2.72 [W/kg] and the grain size is 63 μm, which is the same level as the symbol ◎ data. The symbol ● datum located in the upper-middle in FIG. 3 corresponds to this sample.

Stress relief annealing shorter than conventional was applied to the samples described above. If a longer stress relief annealing time is applied to the samples, the differences of grain growth and core loss between the samples will become larger.

As described above, the REM content and the Cu content within the appropriate range makes it possible to control the number density, the size and the shape of copper sulfides providing a nonoriented electrical steel sheet with better grain growth without changing the conditions of stress relief annealing. It is also found that a shorter time annealing compared to conventional stress relief annealing condition, i.e., at 750° C. for 2 hours, still allows the achievement of sufficiently low core loss.

All cited patents, publications, copending applications, and provisional applications referred to in this application are herein incorporated by reference.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

EXAMPLES

TABLE 1

| No. | component content: REM [mass %] | Cu [mass %] | REM amount evaluation | evaluation by expression (1) | evaluation by expression (2) | copper sulfide: sphere-equivalent radius 100 nm or less: copper sulfide number density [$\times 10^{10}$ inclusions/mm$^3$] | percentage of copper sulfide with (major axis)/(minor axis) ratio of more than 2 [%] | grain size after annealing [Mm] | iron loss after annealing W15/50 [W/kg] |
|---|---|---|---|---|---|---|---|---|---|
| 1 | 0.0194 | 0.0048 | satisfied | satisfied | satisfied | 0.4 | 19 | 65 | 2.68 |
| 2 | 0.0025 | 0.1800 | satisfied | satisfied | satisfied | 0.6 | 27 | 67 | 2.65 |
| 3 | 0.0009 | 0.0370 | satisfied | satisfied | satisfied | 0.7 | 15 | 66 | 2.71 |
| 4 | 0.0013 | 0.0105 | satisfied | satisfied | satisfied | 0.7 | 7 | 68 | 2.66 |
| 5 | 0.0045 | 0.0110 | satisfied | satisfied | satisfied | 0.9 | 8 | 67 | 2.69 |
| 6 | 0.0008 | 0.2070 | satisfied | satisfied | satisfied | 0.8 | 25 | 65 | 2.70 |
| 7 | 0.0056 | 0.0220 | satisfied | satisfied | not-satisfied | 0.8 | 44 | 56 | 2.82 |
| 8 | 0.0099 | 0.1050 | satisfied | satisfied | not-satisfied | 0.6 | 39 | 58 | 2.81 |
| 9 | 0.0122 | 0.0440 | satisfied | satisfied | not-satisfied | 0.5 | 33 | 57 | 2.81 |
| 10 | 0.0252 | 0.0010 | satisfied | not-satisfied | satisfied | 0.7 | 28 | 58 | 2.79 |
| 11 | 0.0021 | 0.0023 | satisfied | not-satisfied | satisfied | 1.5 | 12 | 34 | 3.33 |
| 12 | 0.0004 | 0.0028 | REM-short | not-satisfied | satisfied | 1.9 | 10 | 32 | 3.41 |
| 13 | 0.0003 | 0.0190 | REM-short | satisfied | satisfied | 1.2 | 17 | 37 | 3.18 |
| 14 | 0.0004 | 0.0750 | REM-short | satisfied | satisfied | 1.1 | 23 | 38 | 3.07 |
| 15 | 0.0343 | 0.0044 | REM-excess | satisfied | satisfied | 0.4 | 22 | 60 | 2.76 |
| 16 | 0.0019 | 0.5800 | satisfied | satisfied | satisfied | 0.8 | 29 | 63 | 2.72 |

REM amount evaluation: if: 0.0005 > [REM], REM short, if 0.0005 ≦ [REM] ≦ 0.03, satisfied, if 0.03 < [REM], REM-excess
Evaluation by expression (1): if: [REM] × [Cu]$^3$ ≧ 7.5 × $10^{-11}$, expression (1) satisfied
Evaluation by expression (2): if: [REM] < 0.003, expression (2) satisfied
if [REM] ≦ 0.003, and ([REM] − 0.003)$^{0.1}$ × [Cu]$^2$ ≦ 1.25 × $10^{-4}$, satisfied

The invention claimed is:

1. A nonoriented electrical steel sheet comprising:

by mass %,

C: 0.01% or less,

Si: 0.1% or more and 7.0% or less,

Al: 0.005% or more and 3.0% or less,

Mn: 0.1% or more and 2.0% or less,

S: 0.0005% or more and 0.005% or less,

Cu: 0.5% or less and 0.001% or more, rare earth element (REM): 0.0005% or more and 0.03% or less, and the balance Fe and unavoidable impurities, wherein the following expression (1) is met, $$[REM]\times[Cu]^3 \geqq 7.5\times10^{-11} \quad (1)$$

where [REM] represents REM mass % and [Cu] represents Cu mass %, and wherein the number density of copper sulfides having a sphere-equivalent radius of 100 nm or less is $0.4\times10^{10}$ [inclusion/mm$^3$] or more, and $1\times10^{10}$ [inclusion/mm$^3$] or less.

2. A nonoriented electrical steel sheet comprising:

by mass %,

C: 0.01% or less,

Si: 0.1% or more and 7.0% or less,

Al: 0.005% or more and 3.0% or less,

Mn: 0.1% or more and 2.0% or less,

S: 0.0005% or more and 0.005% or less,

Cu: 0.5% or less and 0.001% or more,

REM: 0.0005% or more and 0.03% or less, and the balance Fe and unavoidable impurities, wherein, if 0.0005≦[REM]<0.003, the following expression (1) is met, and, if 0.003≦[REM]≦0.03, the following expressions (1) and (2) are met, $$[REM]\times[Cu]^3 \geqq 7.5\times10^{-11} \quad (1)$$

$$([REM]-0.003)^{0.1}\times[Cu]^2 \leqq 1.25\times10^{-4} \quad (2),$$

where [REM] represents REM mass % and [Cu] represents Cu mass %, wherein the number density of copper sulfides having a sphere-equivalent radius of 100 nm or less is $0.4\times10^{10}$ [inclusion/mm$^3$] or more, and $1\times10^{10}$ [inclusion/mm$^3$] or less, and wherein copper sulfides with a (major axis)/(minor axis) ratio of more than 2 is 30% or less in the copper sulfides having a sphere-equivalent radius of 100 nm or less.

* * * * *